United States Patent [19]

Schneider et al.

[11] Patent Number: 5,042,199

[45] **Date of Patent: * Aug. 27, 1991**

[54] PREFABRICATED WINDOW SYSTEM

[75] Inventors: Josef Schneider, Erlangen; Rolf-Peter Lange, Nüremberg, both of Fed. Rep. of Germany; Randy C. Hoover, Lovettsville; James A. Ruby, Waterford, both of Va.; Peter A. Turner, Winnipeg, Canada

[73] Assignee: Rehau AG+ Co., Rehau, Fed. Rep. of Germany

[ * ] Notice: The portion of the term of this patent subsequent to Jun. 12, 2007 has been disclaimed.

[21] Appl. No.: 380,748

[22] Filed: Jul. 17, 1989

Related U.S. Application Data

[63] Continuation of Ser. No. 929,303, Nov. 12, 1986, abandoned.

[51] Int. Cl.[5] ..... E05F 1/00

[52] U.S. Cl. ..... 49/446; 49/501; 49/DIG. 1

[58] Field of Search ..... 49/446, 504, DIG. 1; 52/204, 208, 207, 206, 285, 212

[56] References Cited

U.S. PATENT DOCUMENTS

| | | | |
|---|---|---|---|
| 3,287,856 | 11/1966 | Passovoy | 49/504 |
| 3,436,885 | 4/1969 | Rothermel | 52/207 |
| 4,226,066 | 10/1980 | Persson | 49/504 |
| 4,259,813 | 4/1981 | Winner et al. | 49/504 |
| 4,286,716 | 9/1981 | Budich et al. | 49/504 |
| 4,361,994 | 11/1982 | Carver . | |
| 4,555,868 | 12/1985 | Mancuso | 49/504 |
| 4,686,805 | 8/1987 | Forslin | 52/204 |
| 4,768,316 | 9/1988 | Haas | 52/204 |
| 4,932,453 | 6/1990 | Hoover et al. | 49/446 |

FOREIGN PATENT DOCUMENTS

| | | | |
|---|---|---|---|
| 0257896 | 10/1967 | Austria | 49/504 |

OTHER PUBLICATIONS

Rehau's S-698 Window System, pp. 1-6, AS, AR, AAR, and AAS brochure and drawings provided by the applicant.

Annotated blueprint of REHAU S 698 window.

Annotated blueprint on REHAU S 698 window.

Brochure entitled "REHAU Windows S 698," front cover through p. 6, no date.

*Primary Examiner*—Kenneth J. Dorner
*Assistant Examiner*—Gerald Anderson
*Attorney, Agent, or Firm*—Spencer & Frank

[57] ABSTRACT

A prefabricated window system includes a main frame which is fabricated from thermoplastic elements having substantially the same cross-sectional configuration. Windows and a screen are slideably mounted in the main frame. A thermoplastic sill is snap-connected to the bottom portion of the frame and a decorative cover is snap-connected to the top portion. Stop elements, having the same cross-sectional configuration as the cover element, are snap-connected to the side portions of the frame in order to prevent the windows from being raised or lowered too far. The windows can be pivoted for cleaning, and the frame includes portions which overlap the outer peripheries of the windows to prevent them from inadvertently being rotated outward. These portions also reduce air incursion. A latch is mounted on one window and a keeper which cooperates with the latch is mounted on the other, the keeper being firmly mounted in the window sill by upwardly extending screws. Slots are provided around the periphery of the main frame to accommodate nailing fins which are used during installation of the window system or to receive mullion covers which join adjacent window systems.

28 Claims, 7 Drawing Sheets

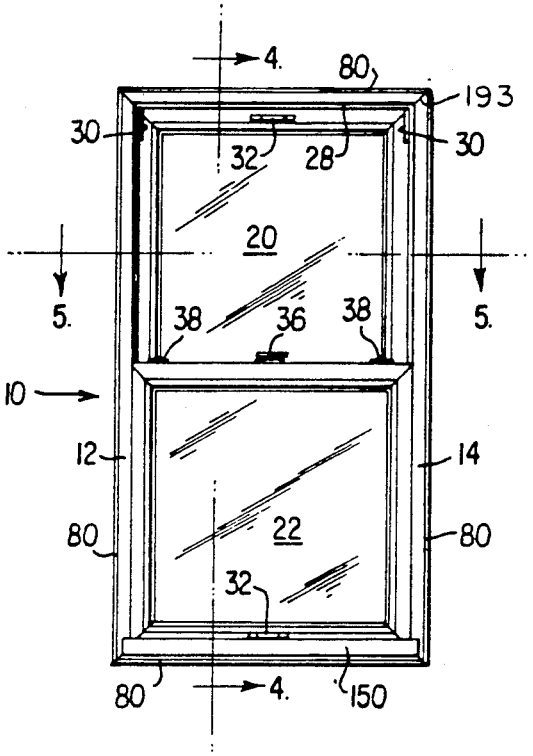
FIG. 1
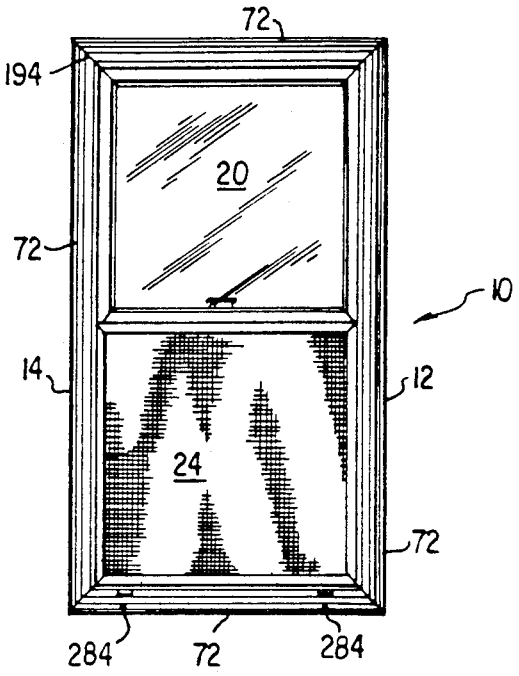
FIG. 2
FIG. 3
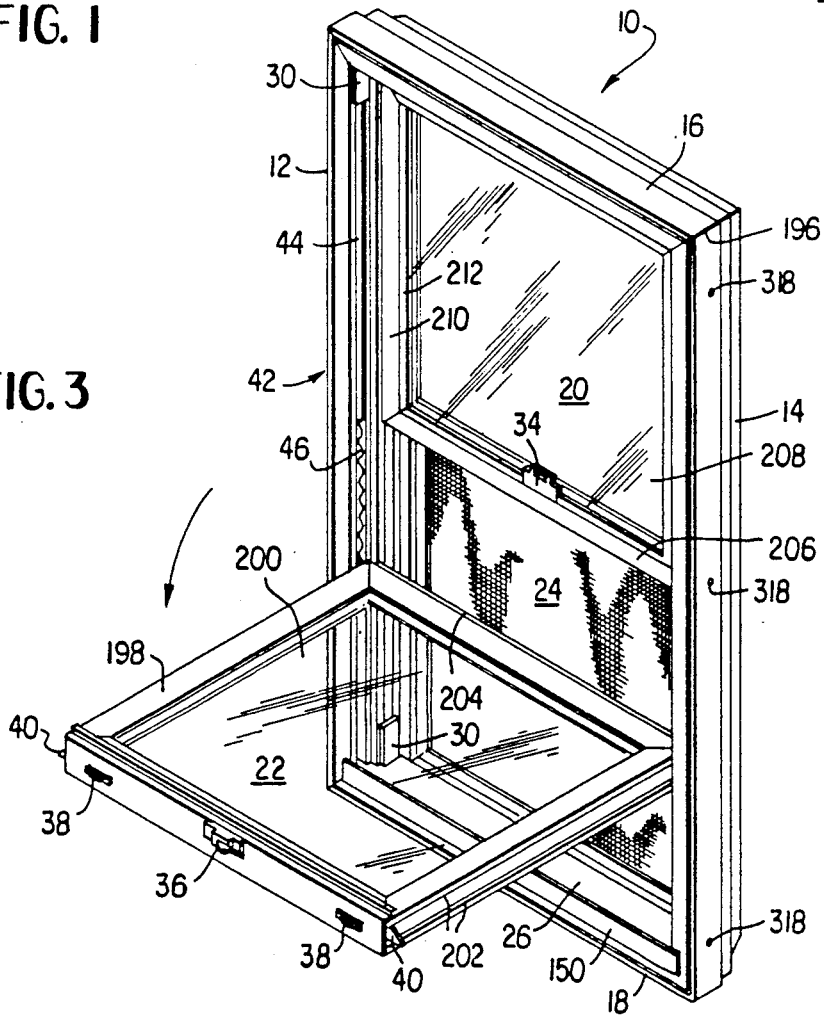

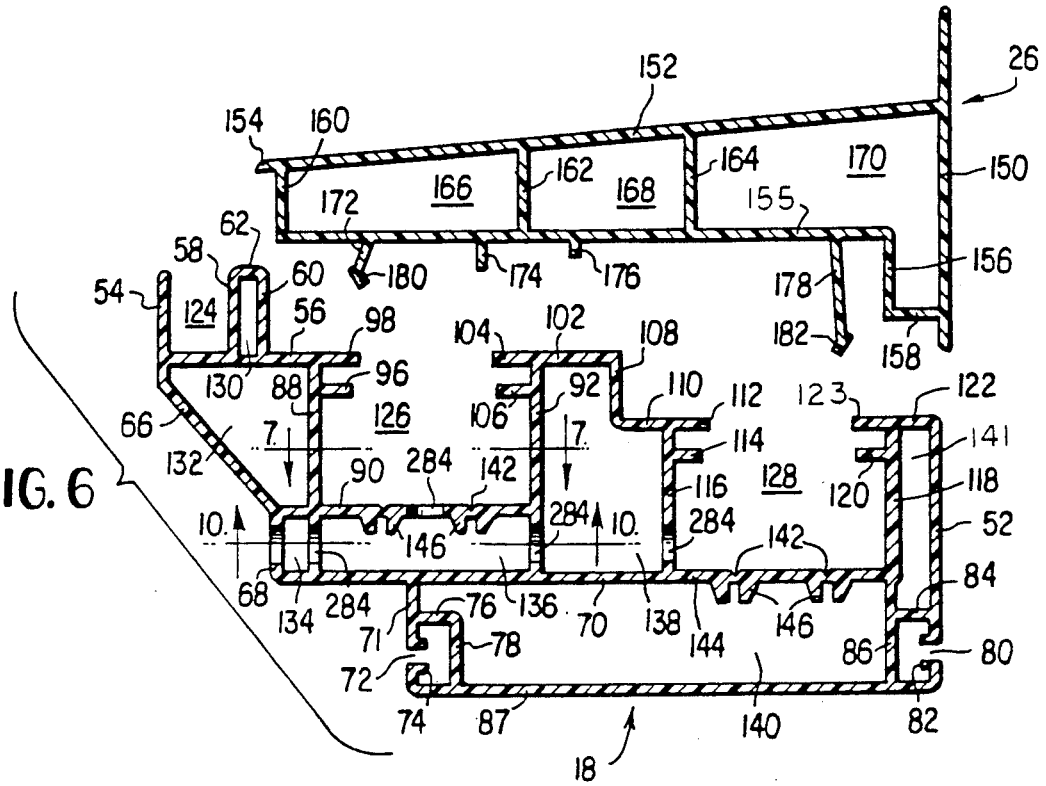
FIG. 6
FIG. 7
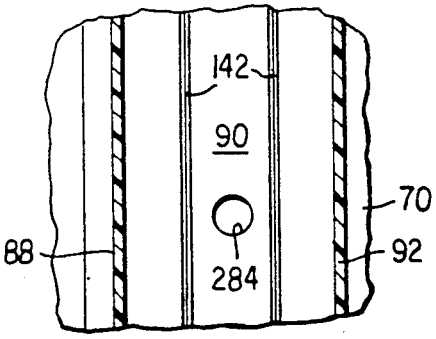
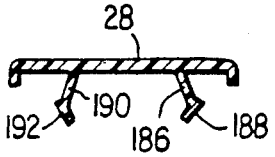
FIG. 8
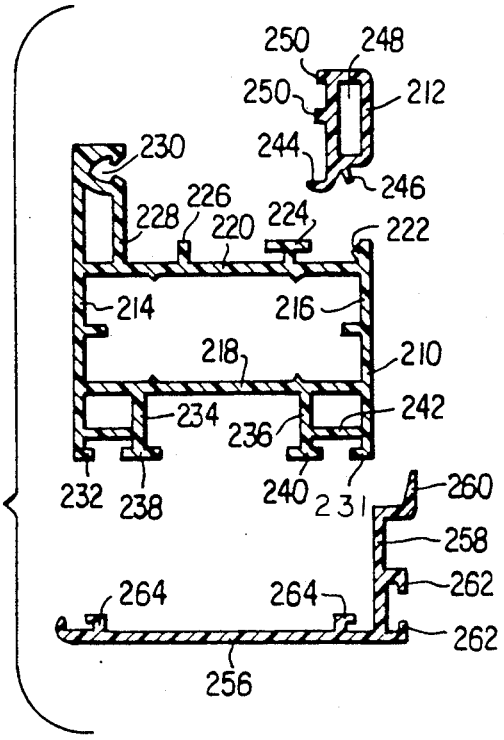
FIG. 9

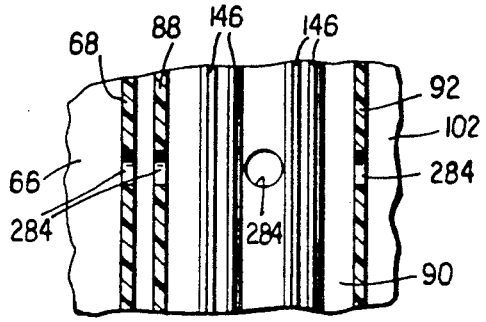
FIG. 10
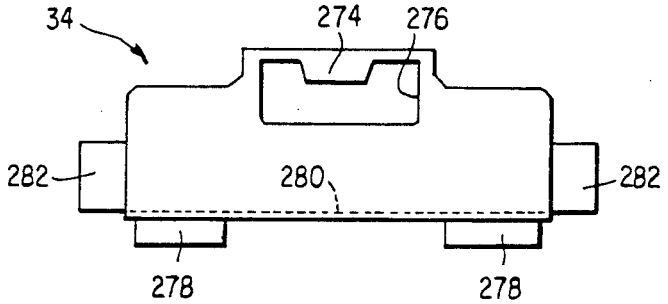
FIG. 11
FIG. 12
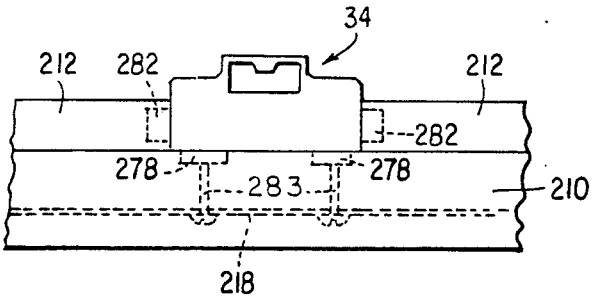
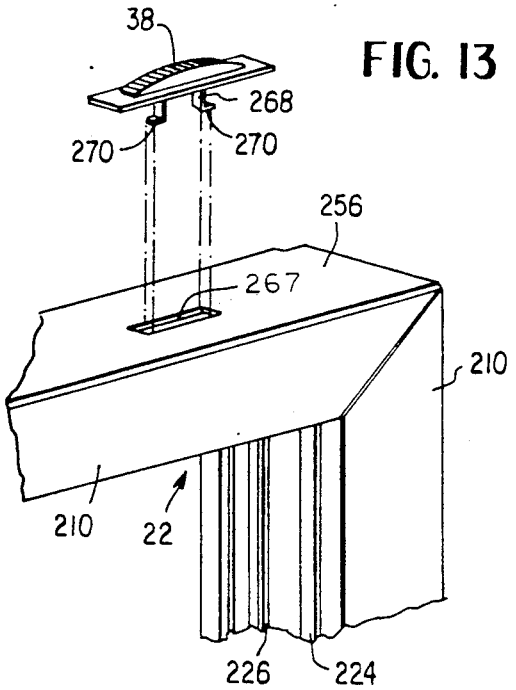
FIG. 13
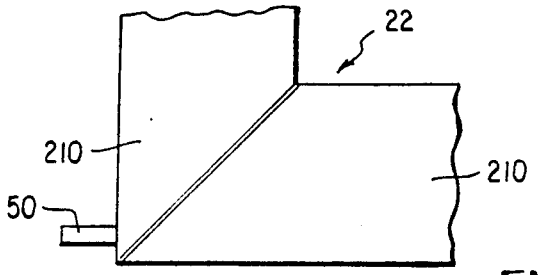
FIG. 14

PREFABRICATED WINDOW SYSTEM

This application is a continuation of application Ser. No. 06/929,303, filed Nov. 12, 1986, now abandoned.

BACKGROUND OF THE INVENTION

The present invention relates to a prefabricated window system, and more particularly to a prefabricated window system having a main frame and other elements which are fabricated from extruded thermoplastic elements.

Prefabricated windows are frequently used, both for new construction and replacement purposes, in order to provide high quality at a moderate cost. The desireable attributes of a prefabricated window are easier to state than to achieve. The window should be relatively inexpensive both to purchase and to install, but it should nevertheless offer excellent security against the elements. Furthermore the window should be attractive and sufficiently rugged to withstand abuse. Finally, these qualities should be present not only at the time of installation but for many years thereafter, so that the window sashes can be moved without sticking despite the passage of time.

The S 698 (TM) prefabricated window system of Rehau Plastics, Inc., having an office in Leesburg, Virginia, achieves the aforesaid qualities to an admirable degree. The S 698 window employs a main frame and other members fabricated from extruded thermoplastic elements. The present invention further advances the qualities of the S 698 window system.

SUMMARY OF THE INVENTION

An object of the invention is to provide an improved window system.

Another object of the invention is to provide a prefabricated window system having an improved main frame with wall portions which overlap the outer edges of the window sashes to reduce air incursion and to prevent inadvertent outward rotation of the windows.

Another object of the invention is to provide a prefabricated window system having an improved main frame which has a top portion which receives a snap-in decorative cover and side portions which receive snap-in window stops, the window stops and decorative cover having the same cross-sectional configuration.

Another object of the invention is to provide a prefabricated window system having an improved main frame with grooves at the periphery thereof to receive nailing fins for attaching the main frame to a structure or to receive mullion covers for connecting one main frame to another.

Another object of the invention is to provide a prefabricated window system having a keeper which is connected to a window sash by screws which extend upwardly through the sash to the keeper, which has a hook to engage a rail molded into the sash, and which has tabs that extend into cavities in glazing beads on either side of the keeper.

These and other objects which will become apparent in the ensuing detailed description can be attained by providing a window system which comprises a generally rectangular main frame having a top frame portion, a bottom frame portion, and a pair of side frame portions. Each frame portion is a thermoplastic element having an inner region which faces the interior of the rectangle and an outer region which faces away from the interior. Each frame portion includes an outer panel, a first intermediate panel which is spaced inward from the outer panel, and first and second walls which are attached to the first intermediate panel and which extend inward from the first intermediate panel. The first and second panels are spaced apart to provide a channel. Each frame portion also includes a second intermediate panel and third and fourth walls which are attached to the first intermediate panel and which extend inward from the first intermediate panel, the second intermediate panel extending between the third and fourth walls. The third and fourth walls are spaced apart to provide a further channel. Each frame portion also includes means connecting the second and third walls for forming a first step between the channel and the further channel, an inner panel connected to the fourth wall, and means connected to the inher panel for forming a second step. The window system also includes a window and means extending into the channels of the side frame portions for slidably mounting the window in the main frame with the outer side of the window facing the first step, together with a further window and means extending into the further channels of the side frame portions for slidably mounting the further window in the main frame so that the outer side of the further window faces the second step of the side frame portions.

BRIEF DESCRIPTION OF THE DRAWINGS

FIG. 1 is a front view of a window system in accordance with the invention in its un-installed state;

FIG. 2 is a rear view of the window system in its un-installed state;

FIG. 3 is a perspective view of the window system in its un-installed state;

FIG. 6 a sectional view through the main frame and sill;

FIG. 7 is a sectional view taken along line 7—7 of FIG. 6;

FIG. 8 is a sectional view of a cover element which snaps into the upper portion of the main frame;

FIG. 9 is a sectional view of a portion of the window sash, a glazing, and a cover element;

FIG. 10 is a sectional view taken along line 10—10 of FIG. 6;

FIG. 11 is a front view of a keeper which is mounted on one of the sash elements;

FIG. 12 is a front view illustrating the keeper of FIG. 11 a sash element and glazing beads;

FIG. 13 is an exploded perspective view illustrating a button which is mounted on a window sash to permit retraction of a tilt mechanism;

FIG. 14 is a front view illustrating a pivot bar which extends from the lower corner of a window sash;

DESCRIPTION OF THE PREFERRED EMBODIMENTS

Figure 5:
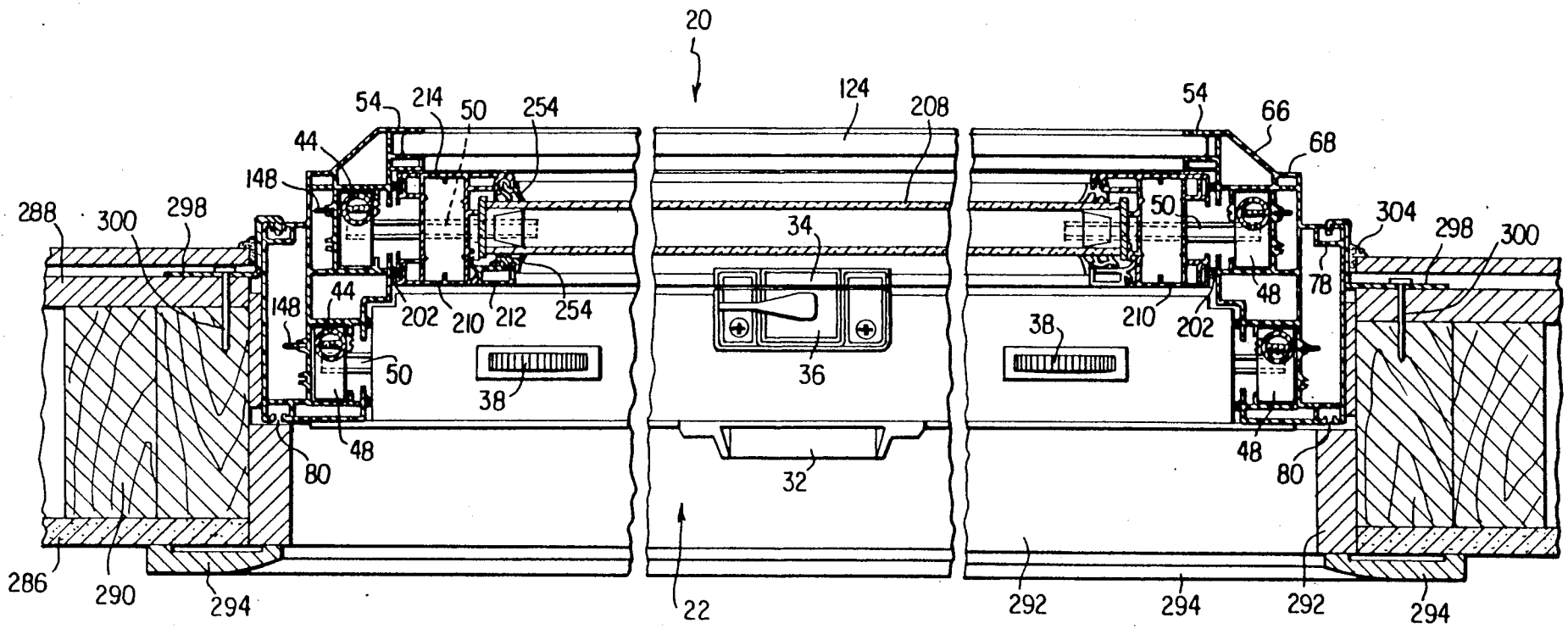
FIG. 5 is a sectional view, taken along line 5—5 of FIG. 1, illustrating the window system in its installed state.
Figure 23:
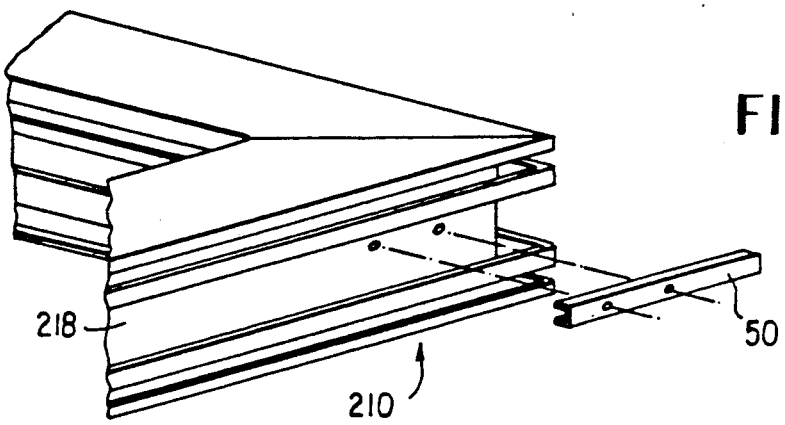
FIG. 23 is an exploded perspective view illustrating how a pivot bar is mounted to a window sash.

A window system in accordance with the present invention is illustrated generally in FIG. 3 in its uninstalled state, and includes a main frame 10 having side portions 12 and 14, top portion 16, and bottom portion 18. The window system also includes top window 20, bottom window 22, and screen 24, which are slideably mounted in channels provided by side portions 12 and 14. A sill 26 is mounted on bottom portion 18 of frame 10, and a decorative panel 28 (see FIG. 1) is mounted on top portion 16. Stop elements 30 are mounted in side portions 12 and 14 to prevent bottom window 22 from being moved upwards far enough to smash into the handle 32 (see FIG. 1) of top window 20, and to prevent top window 20 from being moved downward far enough for its handle 32 to smash into bottom window 22. The window system also includes mounting means, which will be described later, and hardware such as keeper 34, latch 36, buttons 38 for actuating tilt latch mechanisms 40, and balance mechanisms 42 for biasing windows 20 and 22 upward. Balance mechanisms 42 are commercially available and typically either two such mechanisms (one on each side) or four (two on each side) are used with each of windows 20 and 22. Each balance mechanism includes a spring (not illustrated) which is coiled within a tube 44 and which is connected via link 46 to slideably mounted window attachment mechanisms 48 (FIG. 5). Pivot bars 50 (see FIGS. 14 and 23) extend from the bottom of either window to engage mechanisms 48.

FIG. 6 illustrates a cross-sectional view of sill 26 and bottom portion 18 of frame 10. Frame 10 is a primary feature of the window system of the present invention, and is preferably fabricated from a length of an extruded thermoplastic such as vinyl which is cut into sections for use as portion 12, 14, 16, or 18. That is to say, each of these portions has the same general cross-sectional configuration, although for purposes of description the configuration illustrated in FIG. 6 has been identified as portion 18. With minor exceptions which will become apparent, portion 18 in FIG. 6 could alternatively have borne reference number 12, 14, or 16.

With continuing reference to FIG. 6, portion 18 includes a wall 52 which faces the interior of the building in which the window system is installed and a wall 54 which faces the outside (to facilitate discussion the term "wall" in the ensuing description will generally be used to describe elements which are presented vertically in FIG. 6, and "panel" will be used for horizontal members). An inner panel 56 faces the interior of frame 10 (see FIG. 3) and is attached to wall 54. Walls 58 and 60, which are connected by a bridge panel 62, are supported by panel 56. A sloping web 66 connects wall 54 to a wall 68, which terminates at intermediate panel 70. Wall 71 extends from panel 70 and has a slot 72 and inwardly directed lips 74 adjacent slot 72. Panel segment 76 and wall segment 78 are disposed behind slot 72 to provide a chamber into which slot 72 communicates. In a similar manner wall 52 is interrupted by a slot 80 which is bordered by inwardly directed lips 82 and which is closed off by panel segment 84 and wall 86. Outer panel 87 faces away from the interior of frame 10 (see FIG. 3) and connects wall 52 to wall 71.

With continuing reference to FIG. 6, wall 88 extends between panel 56 and panel 70. An intermediate panel 90 connects wall 88 to wall 92, which extends inward from panel 70. A panel flange 96 is connected to wall 88, and wall 56 terminates in a panel flange 98 that is parallel to flange 96. Wall 92 extends inward to a panel 102 which terminates in a panel flange 104. Extending from wall 92 is a panel flange 106 parallel to flange 104. A step 108 connects panel 102 to a panel 110 having a panel flange 112. A panel flange 114 extends from a wall 116 which connects panel 110 to panel 70. Facing wall 116 is a wall 118 having a panel flange 120. A panel 122 connects wall 118 to wall 52 and terminates in a panel flange 123.

It will be apparent that the various walls and panels heretofore described provide channels 124, 126, and 128, along with chambers 130, 132, 134, 136, 138, 140, and 141.

With continuing reference to FIG. 6, two grooves 142 are molded into panel 90 and two grooves 142' are molded into portion 144 of panel 70. Also molded into panel 90 are a pair of screw bosses 146 corresponding to each groove 142, and molded into panel 70 are a pair of screw bosses 146' corresponding to each groove 142'.

The features identified by reference numbers 52 through 146 are present in each of frame portions 12, 14, 16, and 18 (see FIG. 3). However not all of these features are utilized in the same way in each of frame portions 12–18. For example, grooves 142 and 142' and screw bosses 146 and 146' have no function in top portion 16 and bottom portion 18, and are present in these portions only because of their utility in side portions 12 and 14. Plan views of grooves 142 and bosses 146 are illustrated in FIGS. 7 and 10, respectively. The tubes 44 (see FIG. 3) of balance mechanisms 42 are attached to side portions 12 and 14, and grooves 142 and 142' and bosses 146 and 146' are used to facilitate this attachment. As will be noted in FIG. 5, the tubes 44 are secured to portions 12 and 14 by sheet metal screws 148. Grooves 142 and 142' and bosses 146 extend the entire length of side portions 12 and 14 (as, indeed, they extend the entire lengths of top and bottom portions 16 and 18), and accordingly during fabrication of the window system a screw 148 can be slid to the desired height along a groove 142 or 142' and then screwed in with confidence that it is aligned with bosses 146 or 146' on the other side to reliably secure the screw. Although two grooves 142 and their corresponding bosses 146 are provided in channel 126 and two grooves 142' and their corresponding bosses 146' are provided in channel 128 in FIG. 6, and only one tube 44 is mounted in each of the corresponding channels of FIG. 5 (which are not numbered in FIG. 5), it will be recalled that additional balance mechanisms are used with large windows. Accordingly, just as an extruded element (not illustrated) having the general profile illustrated in FIG. 6 can be used to fabricate any of the frame portions 12–18, the provision of redundant grooves 142 and 142′ and 146 and 146′ facilitates the use of such elements as side portions 12 and 14 in either small window systems (two balance mechanisms 42 for each of windows 20 and 22) or large window systems (four balance mechanisms 42 for each of windows 20 and 22).

Returning to FIG. 6, sill 26 includes an inner wall 150 from which extends a sloping web 152 which terminates in an outer lip 154. Bottom panel 155 is connected by wall 156 and panel segment 158 to wall 150. Outer wall 160 and interior walls 162 and 164 connect web 152 to panel 155, and divide this region into chambers 166, 168, and 170. Leg portions 172, 174, 176, and 178 extend downward from panel 155, with leg portion 172 terminating in a hook 180 and with leg portion 178 terminating in a hook 182. Like frame 10, sill 26 is fabricated from an extruded thermoplastic element (not illustrated) which is cut into the desired length. Legs 172 and 178 are resilient, and sill 26 is snap-connected to bottom frame portion 18 so that hook 182 is lodged between panel flanges 120 and 124 and hook 180 is lodged between panel flanges 96 and 98. Leg portion 176 supports the middle region of sill 26 against panel 102, and lip 154 is supported on bridge panel 62. Panel 158 rests against panel 122 to support the inner end of sill 26.

Figure 16:
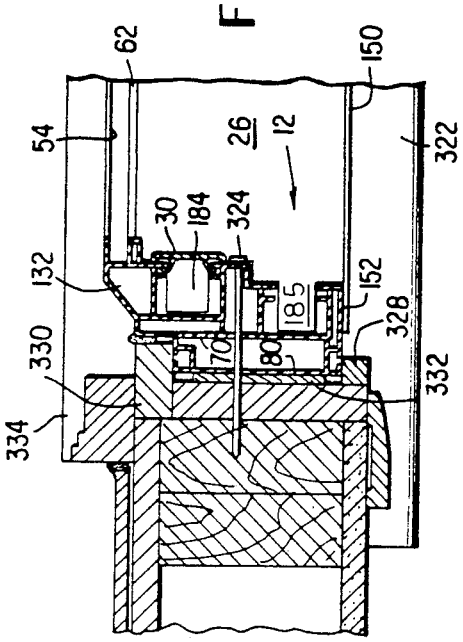
FIG. 16 is a horizontal sectional view illustrating a corner of the main frame and sill of the window system used as a replacement.

Referring next to FIG. 6 and 16 together, each end of sill 26 is shaped to abut against panel 56, panel 90, panel 110, portion 144 of panel 70, and panel 122 of side portions 12 and 14 (see FIG. 3) of main frame 10, with tongue 184 extending into channel 126 and with tongue 185 extending into channel 128.

Turning next to FIGS. 1, 6, and 8, panel 28 is provided with a leg portion 186 which terminates in a hook 188 and with a leg portion 190 which terminates in a hook 192. Panel 28 is preferably fabricated from an element (not illustrated) of extruded thermoplastic, and leg portions 186 and 190 are flexible. The same extruded element from which panel 28 is cut also provides shorter segments for use as stop elements 30, since elements 30 have the same cross-sectional configuration as panel 28. When used as panel 28, hook 188 snaps into the region between panel flanges 120 and 123 of top frame portion 16, and hook 192 snaps into the region between panel flanges 112 and 114. This provides a cosmetic feature, hiding chamber 128 of top frame portion 116 from the interior of the building. Because of the intervening presence of top window 20, another panel 28 is not snapped into channel 126 of top portion 16. When the element is cut into short lengths for use as stop elements 30, four such elements are needed. One is snapped into the bottom part of channel 128 of side portion 14 and another is snapped into the bottom part of channel 128 of side portion 12, thereby providing stops which limit the downward motion of window 20. Another element is snapped into the top portion of channel 126 of side portion 12, and the last element is snapped into the top portion of channel 126 of side portion 14, thereby providing stops to limit the upward motion of window 22.

Referring next to FIGS. 1, 2, and 3, portions 12, 14, 16, and 18 are joined at the corners by interior welds 193, exterior welds 194, and lateral welds 196, and these corner welds impart both rigidity and a finished appearance to main frame 10. In this context the term "weld" means that the corners have been joined by molten thermoplastic which, when it cools, seals one frame portion with an adjacent portion along a smooth seam. Sill 26, panel 28, and stop elements 30 are snapped into main frame 10 as previously mentioned but are not welded thereto.

Returning to FIG. 3, window 22 includes a sash 198 in which an insulated glazing unit 200 (which includes two panes of spaced-apart glass) is mounted. Weather proofing elements such as brush seals 202 and gasket seal 204 are mounted at the edges of sash 198. Top window 20 similarly includes a sash 206, a glazing unit 208, and weather proofing elements (not illustrated in FIG. 3). Each of sashed 198 and 206 includes four sash portions 210 of extruded thermoplastic, sash portions being welded at the corners. A glazing bead 212 is mounted on each sash portion 210.

FIG. 9 illustrates, inter alia, the cross-sectional configuration of a sash portion 210 and glazing bead 212. Portion 210 includes walls 214 and 216 which are connected by panels 218 and 220. A lip 222, a rail 224, a flange 226, and a wall 228 having a cavity 230 extend from panel 220. Wall 210 terminates in a flange 231 and wall 214 terminates in a flange 232. Wall segments 234 and 236 extend from panel 218 and terminate, respectively, in rails 238 and 240. Between wall 210 and wall 236 is a panel 242.

Glazing bead 212 is provided with a hook 244 for engagement beneath rail 224 and with a foot 246 for engagement with lip 222. Within bead 212 is a channel 248, and flanges 250 extend to one side.

Figure 4:
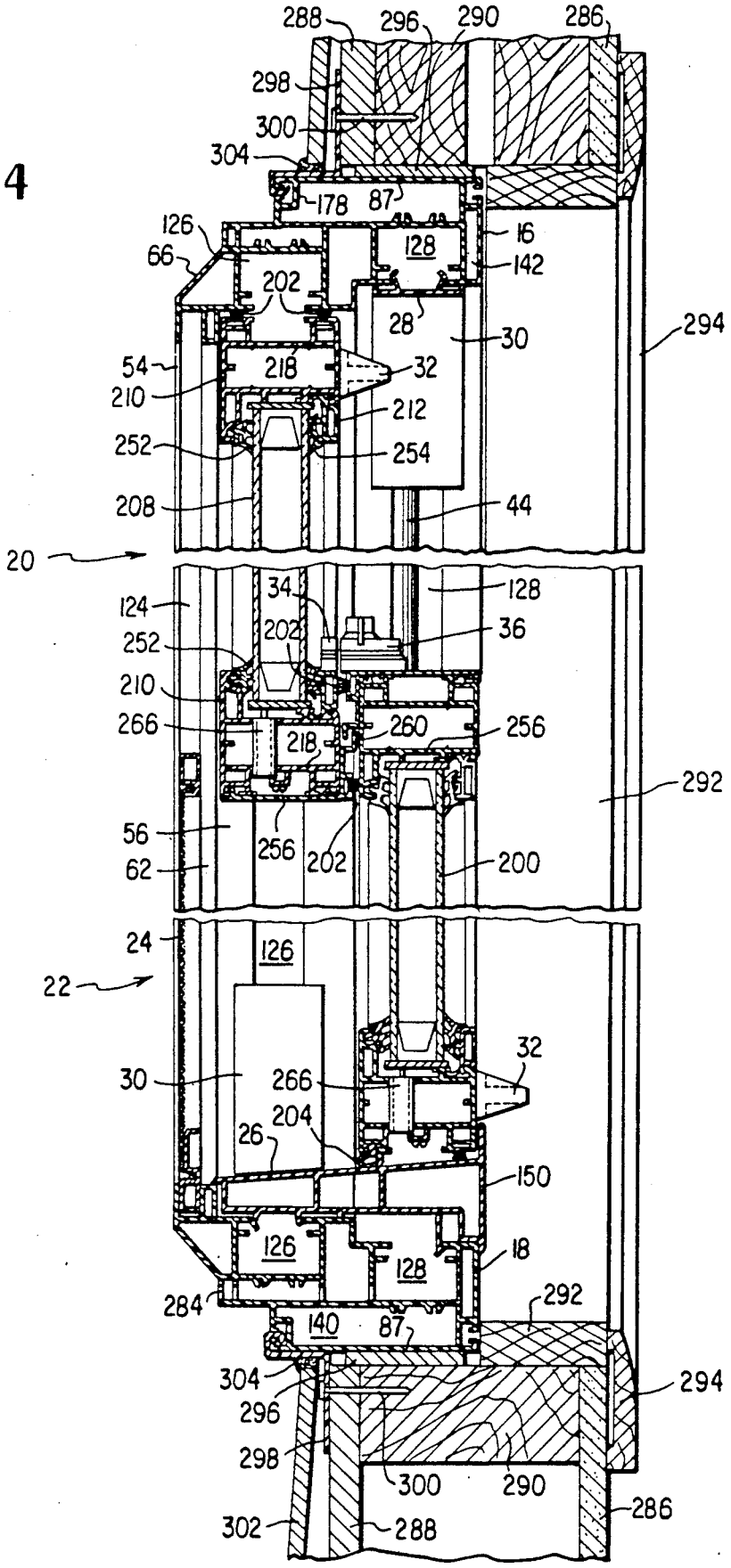
FIG. 4 is a sectional view, taken along line 4—4 of FIG. 1 illustrating the window system in its installed state.

With reference next to FIG. 4 in conjunction with FIG. 9, the construction of window 20 will now be described. Sealed glazing unit 208 is supported by flanges 226 and rails 224 of the four sash portions 210 of window 20. On the outer side, a resilient glazing spline 252 is lodged into the cavities 230 and presses against the outer pane of glazing unit 208. Hook 244 and foot 246 of glazing beads 212 mount beads 212 on sash elements 210 as previously described, and flanges 250 hold another glazing spline 254 against the inner pane of glazing unit 208. Brush seals 202 are retained between flange 231 and rail 240, and between flange 232 and rail 238, of the upper sash portion 210 of window 20. Additionally, flange 231, rail 240, flange 232, and rail 238 of the side sash portions of window 20 (see FIG. 5) also mount brush seals 202.

Returning to FIG. 9, cover element 256 has a wall 258 which terminates in an interlock lip 260. Cover element 256 has flanges 262 and 264.

Figure 24:
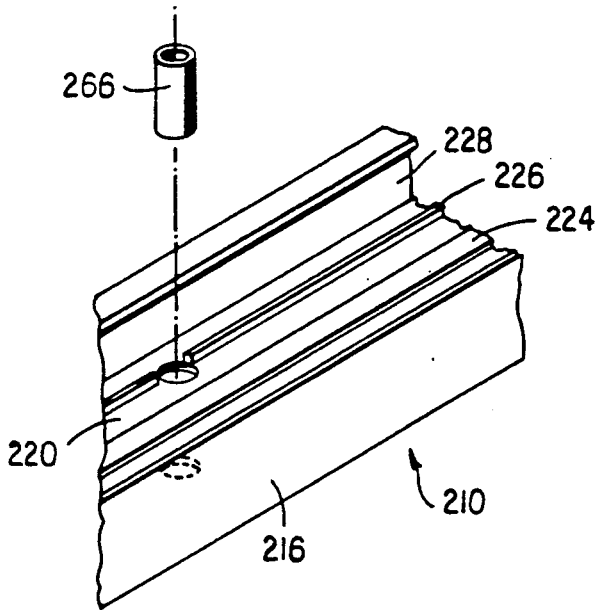
FIG. 24 is an exploded perspective view illustrating a drainage tube in a window sash.

Referring to FIGS. 4 and 9 together, a tube 266 extends through panels 218 and 220 of the lowermost sash portion 210 of top window 20 (also see FIG. 24). Tube 266 drains condensation from the region adjacent glazing unit 208. Furthermore, a cover element 256 is mounted on this lowermost sash portion 210 by sliding flanges 264 beneath flanges 230 and 232. A brush 202 is secured between flanges 262. As will be noted from FIG. 4, the interlock lip 260 of the cover element 256 mounted on the lower sash portion 210 of outer window 20 is directed upward. The construction of inner window 22 is very similar to that of outer window 20, except that the cover element 256 is mounted on the upper (rather than the lower) sash portion 210, and its interlock lip 260 (not numbered in FIG. 4) faces downward. When windows 20 and 22 are closed, their interlock lips 260 are closely spaced and provide an additional barrier to incoming air. Additionally, as will be seen from FIG. 4, each cover element 256 supports a brush seal 202 which engages the other element 256 and thus impedes air incursion.

Figure 22:
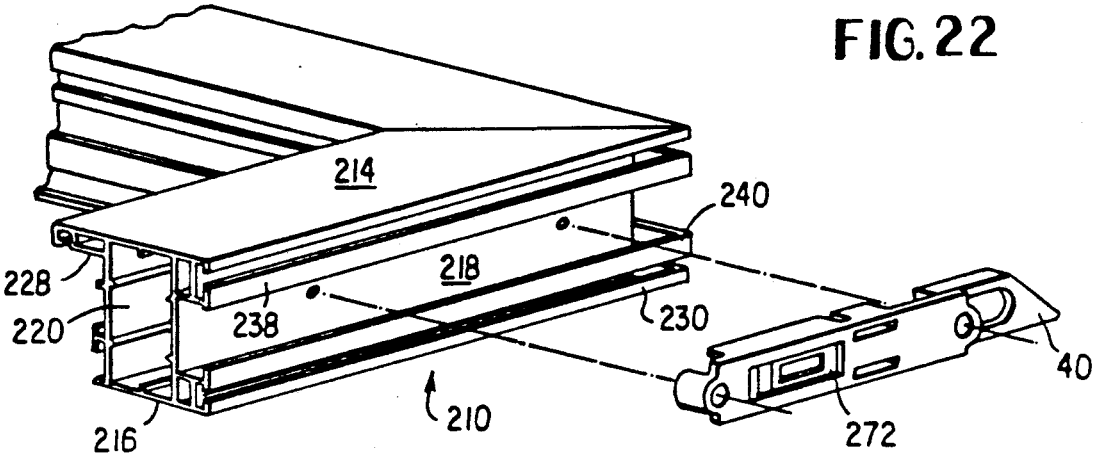
FIG. 22 is an exploded perspective view illustrating how a tilt latch mechanism is mounted to a window sash.

With reference next to FIGS. 3, 13, and 22, near either end of the uppermost sash portion 210 of inner window 22 is mounted a tilt latch mechanism 40, which is a manually retractable mechanism biased outward by a spring (not illustrated). Mechanisms 40 are mounted to panel 218 by screws (not illustrated). Cover element 256 is provided with openings 267 which are positioned above each mechanism 40. Buttons 38 have resilient legs 268 which terminate in feet 270 which snap into recesses 272 of tilt latch mechanisms 40 to operatively ,connect the buttons 38 to the mechanisms 40. The openings 267 are dimensioned to permit buttons 38 to be manually displaced in order to withdraw tilt latch mechanisms 40 and permit window 22 to be pivoted inward on its pivot bars 50 (see FIGS. 14 and 23) as illustrated in FIG. 3. Although not illustrated, top window 20 is also pivotably mounted and provided with latch mechanisms 40.

Turning next to FIGS. 9, 11, and 12, keeper 34 is a metal element having a downward projection 274 and a cavity 276 which extends around projection 274. (When latch 36 is actuated, a cam member, not illustrated, rotates from latch 36 into cavity 276 to lock windows 20 and 22). Bosses 278 having threaded screw holes (not illustrated) are provided at the bottom of keeper 34, and a hook 280 is provided at the rear. Tabs 282 extend from either side of keeper 34. Keeper 34 is centrally mounted on the lowermost sash portion 210 of outer window 20. During fabrication holes (not illustrated) for accommodating bosses 278 are drilled through panel 220, between lip 222 and rail 224. Holes (not illustrated) for screws 284 are also drilled through panels 218 and 242, with the holes through panel 242 having a sufficient diameter to permit the heads of screw 284 to pass through. With the sash portion 210 being prepared in this way, keeper 34 is inserted between two lengths of glazing bead 212, with the tabs 282 extending into the channels 248. The glazing beads 212 and keeper 34 are then installed as a unit into the sash portion 210, with the hook 280 of keeper 34 being engaged together with hooks 244 beneath rail 224. Screws 283 are then installed to permanently connect keeper 34 to the sash portion 210. As a result keeper 34 is attractively and very securely mounted, since hook 280, tabs 282, and screws 278 all participate in the mounting.

Referring next to FIGS. 3, 4, 5, and 6, the window system of the present invention is provided with means for draining water from main frame 10. Screen 24 is slideably guided by channels 124 of the side frame portions 12 and 14, and outer wall 54 of bottom frame portion 18 is provided with an opening (not illustrated) for draining rain which accumulates in channels 142. Outer window 20 is connected by its pivot bars 50 to window attachment mechanisms 48 which are slideably mounted in the channels 126 of side portions 12 and 14, and it will be apparent that rain water can run through channels 126 of side portions 12 and 14 when outer window 20 is in its raised position. This water drains into the channel 126 of lower frame portion 18. The pivot bars 50 of inner window 22 extend to window attachment mechanisms 48 which are slideable along the channels 128 of side portions 12 and 14, and although channels 128 are not as exposed as channel 126 it is still possible for small amounts of water to seep to into channels 128 via the crevices between inner window 22 and side frame portions 12 and 14. This water, too, drains into bottom frame member 18. Finally, water may enter bottom frame portion 18 at sill 26, in the region of tabs 184 and 186 (FIG. 16). To provide drainage, and thereby prevent an accumulation of stagnant water or perhaps even a discharge of water inside the building, bottom portion 18 is provided with drainage holes 284 through panel 90 and walls 68, 92, 94, and 116.

Returning to FIG. 6, one of the features of a window system in accordance with the present invention is its resistance to sticking. Most windows have a tendancy to stick as time progresses; for example, a window with a wooden main frame and wooden sashes may absorb water and swell, and metal used for these elements may corrode. While thermoplastic neither absorbs water nor corrodes, it is subject to distortion due to long exposure to the sunshine. The distortion problem is exacerbated in warm climates, particularly if the thermoplastic is colored so as to absorb rather than reflect infrared radiation. To combat this problem, in FIG. 6 walls 162 and 164 not only contribute mechanical strength to sill 26, they also separate the interior into chambers 166, 168 and 170. These chambers are relatively isolated from each other in a thermal sense and thus provide buffers which inhibit transfer of heat to surfaces subject to sticking. Chambers 130, 132, 134, 136, and 140 also provide buffer chambers which tend to shield the inner portions of main frame 10 from the deleterious effects of solar heating Referring next to FIG. 3 and 6, walls 60 and step 108 have a two-fold significance. Step 108 overlaps the outer edge of bottom window 22 when it is in its normal position, and thus inhibits air infiltration around the edges of window 22. Moreover, when window 22 is returned to its normal position after having been pivoted as illustrated in FIG. 3, step 108 limits the motion of window 22 and, even if window 22 is slammed, prohibits it from rotating outward. It will be apparent that wall 60 provides the same advantages for upper window 20. For upper window 20 the stopping function of wall 60 when the window is pivoted is even more important, since without the stopping function there would be a danger that window 20 might become detached, if it were slammed hard enough, and constitute a possible safety hazard to those outside the building. During normal use the outer surface of window 20 is quite close to step 108 and the outer surface of window 22 is similarly close to wall 60. Windows 20 and 22 may touch step 108 and wall 60, but at any rate for good resistance to air incursions the gap should be limited to less than five millimeters, and preferably in the range of one or two millimeters.

FIGS. 4 and 5 illustrate how the window system of the present invention may be installed in new construction. In these Figures interior and exterior panels 286 and 288 are supported by framing members such as two by fours 290. During construction an opening is left for the window system, and the interior portion of this opening is lined with strips 292. Internal trim 294 is also attached. After this preparation has been completed, the window is inserted into the opening through the outer side, with shims 296 being used to avoid gaps. The window system is then completed by "nailing fins" 298, which are plugged into main frame 10 as will be discussed and which are then secured by nails 300. Thereafter outer siding 302 is applied and the window system is sealed thereto by caulk 304. It will be apparent that differences in construction and material may lead to variations in the installation procedure that has been described.

Figure 20:
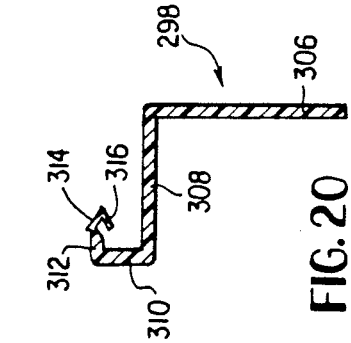
FIG. 20 is a sectional view of the nailing fin employed in FIGS. 4 and 5.

Because of the reduced scale of FIGS. 4 and 5 it is appropriate to continue the discussion of nailing fin 298 with reference to FIGS. 6 and 20. Nailing fin 298 is preferably an extruded thermoplastic element having a cross-sectional configuration as illustrated in FIG. 20. An attachment portion 306 is connected to an outwardly extending portion 308, which in turn is connected by overlapped portion 310 and insertion portion 312 to a locking or arrowhead portion 314. Arrowhead portion 314 is configured to have a resilient leg 316 which is normally biased outward but which is moveable inward. During installation of nailing fin 298, extending portion 308 is pressed against panel 87 of the appropriate frame portion 12, 14, 16, or 18, with arrowhead portion 314 poised to enter the slot 72. The overlap portion 310 is then pounded with a rubber mallet (not illustrated) to drive arrowhead portion 314 through slot 72. In the installed position insertion portion 312 extends between lips 74 and arrowhead portion 314 is locked against the inner ends of lips 74 to permanently attach fin 298 to main frame 10. Thereafter nails 300 are driven through attachment portion 306.

The window system of the present invention may be shipped with four separate nailing fins, one for the slot 72 of each of frame portions 10, 12, 14, and 16. Advantageously, each such nailing fin 298 would be long enough to extend substantially the entire length of the respective slot 72. Instead of shipping separate nailing fins 298 to the construction site, however, it is desireable to weld four nailing fins at their corners so that they can be shipped as a single article, ready for installation, along with the remainder of the window system.

With reference next to FIGS. 3 and 6, nail holes 318 are provided in side frame members 12 and 14. Although not illustrated in FIG. 6, each hole 318 extends through panel 87 and is aligned with nail holes in panels 70 and 102. The holes through panel 102 are closed with plugs (not illustrated) which are removed if the nail holes are to be used.

Figure 15:
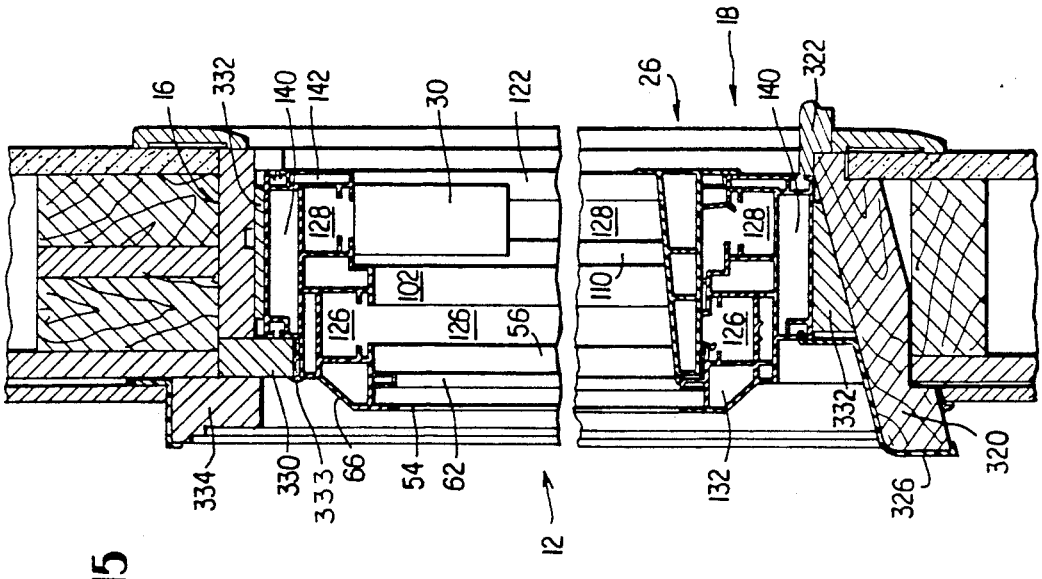
FIG. 15 is a vertical sectional view illustrating the main frame and installed as a replacement window.

FIGS. 15 and 16 illustrate the window system installed as a replacement for a wooden window (not illustrated) that was previously present. Structures such as sill board 320 and ledge 322 remain from the previous installation. Frame 10 is installed with the aid of shims 332, the previously mentioned plugs (not illustrated) are removed, and nails 324 are driven through the nail holes (e.g., 318 in FIG. 3). Sill fin 326 has an arrowhead portion (not numbered) similar to portion 314 in FIG. 20. This arrowhead portion is inserted into the slot 72 of the lower frame element 18, as illustrated in FIG. 15. Additionally, inner and outer strips 328 and 330, caulk 333, and external trim 334 are installed.

Figure 19:
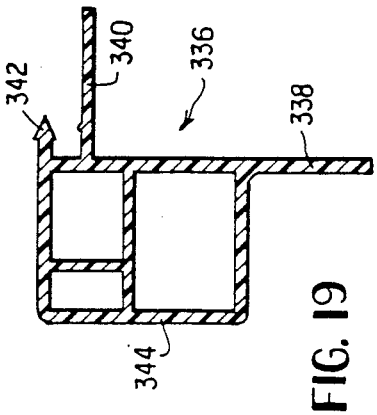
FIG. 19 is a sectional view of a nailing fin having a decorative portion to simulate wooden brick molding.

FIG. 19 illustrates a nailing fin 336 for use in brick construction. Fin 336 includes an attachment portion 338 (corresponding to portion 306 in FIG. 20), an extending portion 340 (corresponding to portion 308 in FIG. 20), and an arrowhead portion 342 (corresponding to portion 314 in FIG. 20). Unlike arrowhead portion 314, portion 342 is not provided with a resilient leg 316 (although this could, of course, be done). Decorative portion 344 is molded to simulate wooden brick molding.

Figure 17:
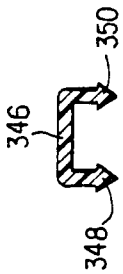
FIG. 17 is a sectional view of a mullion cover for connecting adjacent main frames.

The fact that main frame 10 has peripheral slots 72 on the outer side and peripheral slots 80 on the inside (see FIGS. 1, 2, and 6) makes it easy to mount windows side by side. FIG. 17 illustrates a mullion cover 346 having locking or arrowhead portions 348 and 350. Two mullion covers 346 would be used to join a pair of side-by-side windows mounted in a flat wall. On the outer side, arrowhead portion 348 would be lodged in the slot 72 of one frame 10 and arrowhead portion 350 would be lodged in the adjacent slot 72 of the other frame 10. Similarly, on the inner side arrowhead portions 348 and 350 would be lodged in the slots 80. It will be apparent that the mullion covers 346 thus mechanically connect the windows and avoid an unsightly crack between them.

Figure 18:
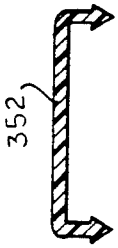
FIG. 18 is a sectional view of modified mullion cover for connecting adjacent main frames when the main frames are to be disposed at an angle.

FIG. 18 illustrates a bow mullion cover 352 for use when adjacent windows are disposed at small angles (e.g., 9°) with respect to each other, as in a bow window. For such use bow mullion cover 352 is used on the outer sides of the windows and connects the slots 72, while a mullion cover 346 is used on the inner sides to connect the slots 80. Being made of thermoplastic, bow mullion cover 352 is somewhat flexible and is thus bendable through a small arc upon installation.

Figure 21:
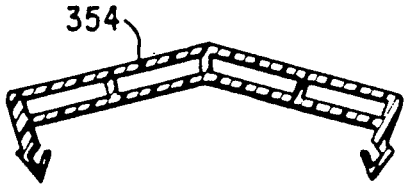
FIG. 21 is a sectional view illustrating a mullion cover for connecting adjacent main frames that are disposed at a relatively large angle with respect to one another.

For larger angles a bay mullion cover 354, as illustrated in FIG. 21, may be used on the outer side to connect adjacent slots 72. Bay mullion cover 354 permits a window-to-window angle of about 30° (although it will be apparent that cover 354 could be fabricated for other angles, such as 45°). Again, on the inner side of the windows a mullion cover 346 would be used.

It will be understood that the above description of the present invention is susceptable to various modifications, changes, and adaptations, and the same are intended to be comprehended within the meaning and range of equivalents of the appended claims.

What we claim is:

1. A window system for use on a wall of a building, comprising:

a generally rectangular main frame having a top frame portion, a bottom frame portion that is spaced apart from the top frame portion, and a pair of spaced-apart connecting frame portions which connect the top and bottom frame portions, all of the frame portions having substantially the same cross-sectional configuration, each frame portion being a thermoplastic element which has an inner region facing toward the interior of the main frame and an outer region facing away from the interior of the main frame and which includes an outer panel, a first intermediate panel which is spaced apart from the outer panel and which is disposed closer to the interior of the main frame than the outer panel, first and second walls which are attached to the first intermediate panel and which extend toward the interior of the main frame, the first and second walls being spaced apart to provide a channel, a second intermediate panel which is spaced apart from the outer panel and which is disposed closer to the interior of the main frame than the first intermediate panel, third and fourth walls which are attached to the second intermediate panel and which extend toward the interior of the main frame, the third and fourth walls being spaced apart to provide a further channel, first means connecting the second and third walls for forming a first step between the channel and the further channel, an inner panel connected to the fourth wall, and second means connected to the inner panel for forming a second step;

a window having an outer side;

third means for slidably mounting the window in the main frame so that the outer side of the window faces the first step of the connecting frame portions, the third means extending into the channels of the connecting frame portions;

a further window having an outer side;

fourth means for slidably mounting the further window in the main frame so that the outer side of the further window faces the second step of the connecting frame portions, the fourth means extending into the further channels of the connecting frame portions; and a thermoplastic sill having means extending into the channel and further channel of the bottom frame portion for snap-connecting the sill to the bottom frame portion, the sill having an upper portion which is configured to drain water toward the outside of the building.

2. The window system of claim 1, wherein for each frame portion the second means comprises a fifth wall connected to the inner panel and extending toward the interior of the main frame.

3. The window of claim 2, wherein each frame portion further includes sixth and seventh walls connected to the inner panel and extending toward the interior of the main frame, the fifth and sixth walls having inner ends which are connected to provide a buffer chamber between the fifth and sixth walls, wherein the sixth and seventh walls are spaced apart to provide another channel, and further comprising a screen member mounted for sliding movement along the another channel of the connecting frame portions.

4. The window system of claim 3, wherein for each frame portion the fourth wall and the inner panel are perpendicular, and wherein each frame portion further includes a web disposed at an acute angle with respect to both the inner panel and the fourth wall, a further buffer chamber being provided between the web, the fourth wall, and the inner panel.

5. The window system of claim 4, wherein each frame portion includes means for providing at least one additional buffer chamber.

6. The window system of claim 1, wherein for each frame portion the first and second intermediate panels have inner sides and outer sides, the inner side of the first intermediate panel having an elongated groove in the channel and the outer side of the first intermediate panel having a pair of elongated screw bosses which are parallel to the groove, the inner side of the second intermediate panel having an elongated further groove in the further channel and the outer side of the second intermediate panel having a pair of further elongated screw bosses which are parallel to the further groove.

7. The window system of claim 6, wherein for each frame portion there is another groove and another pair of screw bosses in the first intermediate panel, and wherein there is an additional groove and additional pair of screw bosses in the second intermediate panel.

8. The window system of claim 1, wherein the upper portion of the sill panel comprises a web, at least a portion of which slopes downward toward the outside of the building, and wherein the sill further comprises a horizontal panel, and means connecting the web and the horizontal panel for forming a plurality of buffer chambers, and wherein the means extending into the channel and further channel of the bottom frame portion are connected to the horizontal panel.

9. The window system of claim 8, wherein the sill additionally has tabs which extend into the channel and the further channel of the connecting frame portions.

10. The window system of claim 1, further comprising a thermoplastic cover element having means extending into the channel of the top frame portion for snap-connecting the cover element to the top frame portion, and thermoplastic stop elements having means extending into the channel of the connecting frame portions for snap-connecting the stop elements to the connecting frame portions, the cover element and stop elements having the same cross-sectional configuration.

11. The window system of claim 10, further comprising additional thermoplastic stop elements having means extending into the further channel of the connecting frame portions for snap-connecting the additional stop elements to the connecting frame portions, the additional stop elements having the same cross-sectional configuration as the stop elements and cover elements.

12. The window system of claim 1, wherein each frame portion further includes means for defining an elongated slot adjacent the outer panel, and further comprising means entering the slot for connecting the main frame to the wall.

13. The window system of claim 12, wherein the means entering the slot comprises a nailing fin having an arrowhead portion which enters the slot, an extension portion which contacts the outer panel, and an attachment portion which is perpendicular to the extension portion, the attachment portion being nailed to the wall.

14. The window system of claim 12, wherein the arrowhead portion comprises a resilient leg.

15. The window system of claim 14, wherein the nailing fin further comprises means connected to the attachment portion for simulating brick molding.

16. The window system of claim 1, wherein for each frame portion the outer panel has tow ends, wherein each frame portion further includes means of defining a first elongated slot adjacent one end of the outer panel and for defining a second elongated slot adjacent the other end of the outer panel, and further comprising mullion means extending into the first slots of adjacent main frames for connecting the adjacent main frames and additional mullion means extending into the second slots of adjacent main frames for connecting the adjacent main frames.

17. The window system of claim 16, wherein the mullion means has a pair of arrowhead portions, each arrowhead portion extending into a first slot, and wherein the additional mullion means has a pair of arrowhead portions, each arrowhead portion extending into a second slot.

18. The window system of claim 17, wherein the distance between the arrowhead portions of the mullion means is different from the distance between the arrowhead portions of the additional mullion means.

19. The window system of claim 1, wherein one of the windows comprises a thermoplastic sash having upper and lower panels and having a rail attached to the upper panel, a glazing bead having a cavity and having a hook which fits under the rail, and a keeper having a tab which fits into the cavity of the glazing bead and having a hook which fits under the rail.

20. The window system of claim 19, wherein said one of said windows further comprises a screw which extends through the lower and upper panels of the sash into the keeper, the screw having an enlarged head which is disposed adjacent the lower panel.

21. The window system of claim 1, wherein each frame portion further includes means integrally mounted on the inner panel for providing another channel, and further comprising a screen member mounted for sliding movement along the another channel of the connecting frame portions.

22. A window system for use on a wall of a building, comprising:

a generally rectangular main frame having a first frame portion, a second frame portion that is spaced apart from the first frame portion, and a pair of spaced-apart connecting frame potions which connect the first and second frame portions, each of the connecting frame portions being a thermoplastic element which has an inner region facing toward the interior of the main frame and an outer region facing away from the interior of the main frame and which includes an outer panel, an intermediate panel which is spaced apart from the outer panel and which is disposed closer to the interior of the main frame than the outer panel, the intermediate panel having an inner side with an elongated groove and having an outer side with at least one elongated protrusion which is adjacent and parallel to the groove, first and second walls which are attached to the inner side of the intermediate panel and which extend toward the interior of the main frame, the first and second walls being spaced apart to provide a channel, the groove in the inner side of the intermediate panel being disposed in the channel, another intermediate panel, the another intermediate panel having an inner side with an elongated groove and an outer side with at least one elongated protrusion which is adjacent and parallel to the groove in the another intermediate panel, and third and fourth walls which are attached to the another intermediate panel and which extend toward the interior of the main frame, the third and fourth walls being spaced apart to provide another channel, the groove in the inner side of the another intermediate panel being disposed in the another channel;

a window;

means for slidably mounting the window in the main frame, the means for slidably mounting including a pair of attachment mechanisms, each attachment mechanism being slidably disposed in the channel of a respective one of the connecting frame portions;

a pair of elongated balance mechanisms, each balance mechanism being disposed in the channel of a respective one of the connecting frame portions in and being joined to the attachment mechanism in the channel of the respective connecting frame portion;

a pair of screws, each screw attaching a balance mechanism to the respective connecting frame portion, each screw extending through the groove in the intermediate panel of the respective connecting frame portion and engaging the at least one elongated protrusion on the intermediate panel of the respective connecting frame portion;

another window;

means for slidably mounting the another window in the main frame, the means for slidably mounting the another window including another pair of attachment mechanism, each another attachment mechanism being slidably disposed in the another channel of a respective one of the connecting frame portions;

another pair of elongated balance mechanisms, each another balance mechanism being disposed in the another channel of a respective one of the connecting frame portions and being joined to the another attachment mechanism in the another channel of the respective connecting frame portion; and another pair of screws, each another screw attaching one of the another balance mechanisms to the respective connecting frame portion, each another screw extending through the groove in the another intermediate panel of the respective connecting frame portion and engaging the at least one elongated protrusion on the another intermediate panel of the respective connecting frame portion.

23. The window system of claim 22, wherein for each connecting frame portion the at least one elongated protrusion comprises a pair of closely spaced screw bosses, both of which are engaged by the respective screw.

24. The window system of claim 22, wherein the inner side of the intermediate panel of each connecting frame portion has a further elongated groove, the groove and further groove being spaced apart, and wherein the outer side of the intermediate panel of each connecting frame portion has at least one further elongated protrusion which is parallel to the further groove and adjacent the further groove.

25. The window system of claim 22, wherein each connecting frame portion further includes another: means connecting the second and third walls for forming a first step between the channel and the another channel; and inner panel connected to the fourth wall; and means connected to the inner panel for forming a second step.

26. The window system of claim 25, wherein the window has an outer side which faces the first step of the side frame portions, and wherein the another window has an outer side which faces the second step.

27. The window system of claim 26, wherein the inner side of the another intermediate panel of each connecting frame portion has a further elongated groove, the groove and further groove in the another intermediate panel being spaced apart, and wherein the outer side of the another intermediate panel of each side frame portion has a at least one further elongated protrusion which is adjacent and parallel to the further groove in the another intermediate panel.

28. The window system of claim 22, wherein each connecting frame portion further includes means for defining an elongated slot adjacent the outer panel, and further comprising means entering the slot for connecting the main frame to the wall.

* * * * *